United States Patent [19]

Griswold, Jr.

[11] Patent Number: 4,776,211

[45] Date of Patent: Oct. 11, 1988

[54] UPLIFT SENSOR

[75] Inventor: Frederick D. Griswold, Jr., Dubuque, Iowa

[73] Assignee: Deere & Company, Moline, Ill.

[21] Appl. No.: 53,935

[22] Filed: May 26, 1987

[51] Int. Cl.[4] ..... G01B 5/28

[52] U.S. Cl. ..... 73/105; 33/521

[58] Field of Search ..... 73/105, 146; 33/521

[56] References Cited

U.S. PATENT DOCUMENTS 4,586,138 4/1986 Mullenhoff et al. ..... 73/105 X 4,604,025 8/1986 Hammond ..... 33/521 X 4,669,300 6/1987 Hall et al. ..... 73/105

*Primary Examiner*—Tom Noland

[57] ABSTRACT

The invention is directed to an uplift sensor for detecting uplift from a planar surface. The sensor comprises wedge-shaped bracket having an elongated member mounted therein which contacts the uplift and in response thereto depresses a hydraulic piston in a hydraulic cylinder thereby producing a hydraulic uplift signal. The sensor is provided with a spring operatively coupled between the elongated member and the mounting bracket for biasing the elongated member downwardly towards the uplift.

19 Claims, 2 Drawing Sheets

UPLIFT SENSOR

BACKGROUND OF THE INVENTION

1. Field of the Invention

The subject invention is directed to a sensor for detecting the uplift in a planar surface.

2. Description of the Prior Art

During warfare, airfields, roads and other larger planar surfaces become targets for destruction. Typically, the enemy will shell or drop bombs on such planar structures. The exploding bombs and shells crater such structures rendering them unusable. It becomes necessary for engineers and other ground personnel to make repairs quickly so that the planar structure can again be used.

A bomb or shell being dropped on a planar surface such as an airfield creates a large hole, called a crater. Surrounding the crater is an uplifted area of concrete that has been pitched upward by the force of explosion. In addition, a large amount of debris litters the surrounding area. To fully access crater damage, it is necessary to measure the actual crater perimeter and the amount of crater uplift. This can be a difficult and dangerous task to perform manually when the airfield is under fire or is littered with unexploded bombs and mines. Therefore, it is desirable to remain with armored vehicles or use remote control vehicles to access and fix the damaged portions of the airfield.

The present invention provides a simple sensor for measuring uplift in the area surrounding the crater than can be readily used from within an armored vehicle or on a remote control vehicle.

SUMMARY OF THE INVENTION

The present sensor comprises a wedge shaped mounting bracket having an elongated pivotally mounted member for sensing uplift. One portion of the elongated member extends from the mounting bracket and is used for contacting the uplift and in response thereto pivots on a pivot pin and depresses a piston located in a hydraulic cylinder. Depressing the piston creates a hydraulic signal that is used to indicate an uplift condition.

The sensor is mounted to the end of an operating member of an armored or remote controlled vehicle, such as an excavator and is positioned to slide along the ground. The wedge shape of the mounting bracket pushes debris aside during the sliding operation. As the uplift engaging tip of the elongated member contacts an uplift from the planar surface, the hydraulic piston is depressed in the cylinder indicating the start of an uplift condition. The mounting bracket is held against the planar surface by the operating arm of the work vehicle.

DETAILED DESCRIPTION

Figure 1:
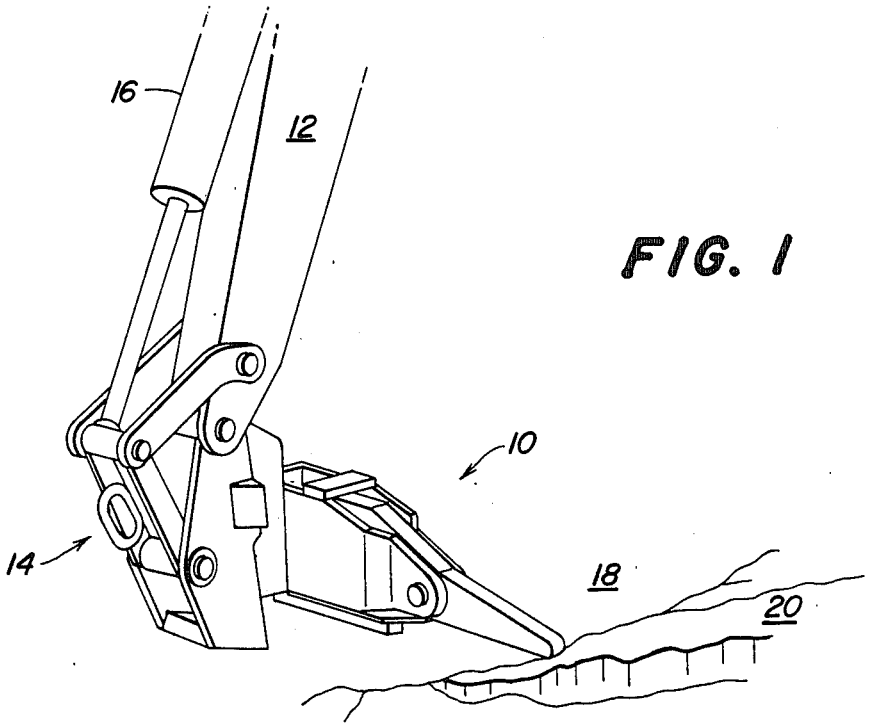
FIG. 1 is a perspective view of the sensor.

FIG. 1 is a perspective view of uplift sensor 10 which is coupled to arm 12 by mounting assembly 14. It is desirable that mounting 14 be a quick attachment assembly to facilitate changeover. Arm 12 is a portion of an operating member of a remote controlled excavator.

Figure 2:
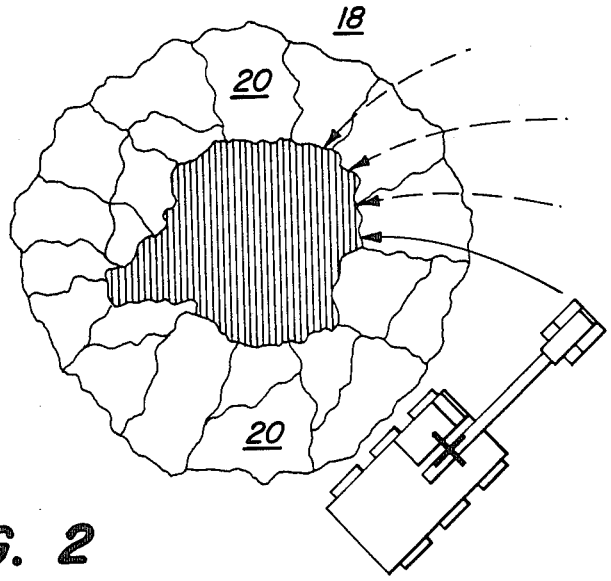
FIG. 2 is a top view of a sensing operation.

Hydraulic bucket cylinder 16 positions sensor 10 perpendicularly against planar surface 18. By rotating the excavator structure, as illustrated in FIG. 2, the sensor can be brought into contact with uplift areas 20.

The excavator vehicle would be provided with a display system for displaying operational data to an armor-protected or remotely located operator.

Figure 3:
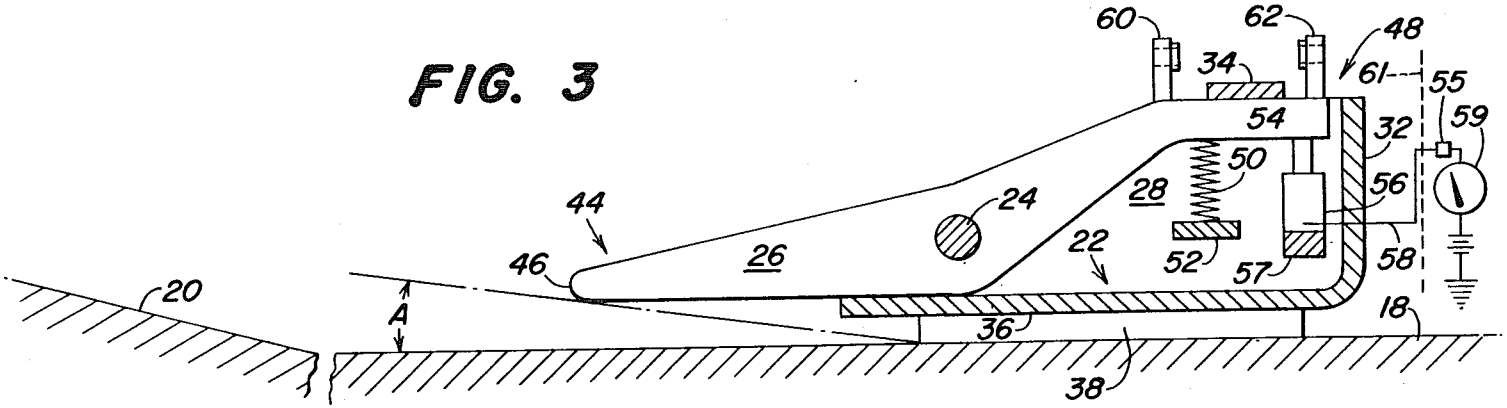
FIG. 3 is a horizontal cross sectional view of the sensor.
Figure 4:
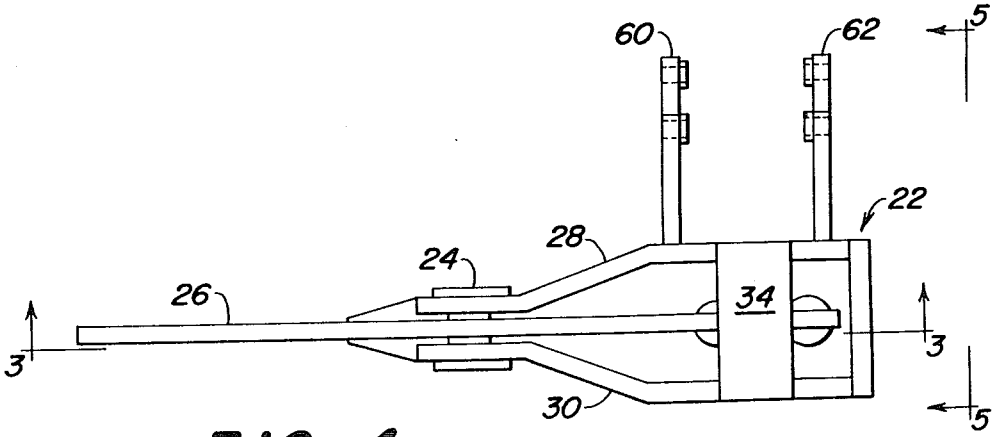
FIG. 4 is a top view of the sensor.
Figure 5:
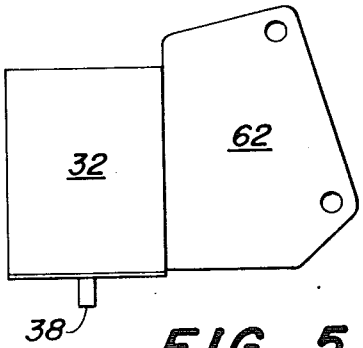
FIG. 5 is a rear view of the sensor.

The sensor itself, better illustrated in FIGS. 3, 4 and 5 comprises mounting bracket 22 having pivot pin 24 on which is pivotally mounted elongated member 26. The mounting bracket is formed from side members 28 and 30 that are coupled to one another by back plate 32, and top and bottom plates 34 and 36, respectively. Mounted to the bottom plate is narrow skid plate 38 which contact the ground and which is adapted and constructed to slide along the planar surface. The side plates from the wedge shape of the sensor and are used to push aside debris surrounding the crater.

Pivotally mounted between the side plates is elongated member 26. The elongated member is mounted on pivot pin 24 which extends across the side plates. The elongated member is provided with an uplift contacting portion 44 having tip 46 and a sensing portion 48. Spring 50 biases tip 46 downward towards the uplift. The spring is operatively positioned between sensing portion 48 of the elongated member and mounting bracket mounting 52. The end of the sensing portion is coupled to hydraulic piston 54 which is operatively positioned in hydraulic cylinder 56. The hydraulic cylinder being secured to mounting 57.

As the uplift contacting tip of the elongated member contacts an uplift the upward force on the elongated member overcomes spring 50 and depresses piston 54 into cylinder 56. The hydraulic piston and cylinder assembly comprises the sensing means of the sensor and transmits an uplift hydraulic signal. The uplift hydraulic signals can be an increase in fluid pressure within the cylinder which can be transmitted through hydraulic line 58 to a more protected area of the vehicle and then detected by electronic pressure sensing means 55 and displayed to an operator display 59.

The sensing means and display means can be located in an operator area having armor 61. If the vehicle is remotely operated, the display information can be transmitted by suitable means, such as a television camera, to a remotely located receiver. The remotely located operator can then manipulate the vehicle through control instructions transmitted to the vehicle.

The mounting bracket is secured to mounting assembly 14 by mounting ears 60 and 62 extending outwardly from side plate 28. In addition, top plate 34 provides a stop for the pivoting of elongated member 40.

The threshold at which uplift is detected is determined by an angle A which is defined by the longitudinal contact axis of skid plate 38 and the axis defined by the forward tip of the skid plate and uplift contacting tip 46. Any uplift smaller than angle A will not contact tip 46 and not be detected, whereas uplift greater than angle A will contact tip 46 and be detected by the sensor.

When operating the sensor, down pressure is exerted on the sensor by the excavator so that the skid plate maintains contact with the planar surface and does not ride up on debris. In addition, the force of the spring and the triggering fluid pressure of the cylinder are selected to reduce false uplift readings from debris contacting tip 46.

The invention should not be limited by the above-described embodiment, but should be limited solely by the claims that follow.

What is claimed is:

1. An uplift sensor for detecting abrupt changes in uplift on a planar surface, the sensor comprising:

a mounting frame having an elongated longitudinal axis, the mounting frame having a bottom which is adapted and constructed to maintain sliding contact with a surface on which said sensor is applied;

an elongated member pivotally secured to the mounting frame substantially parallel to the longitudinal axis of the mounting frame, the elongated member having an uplift contacting portion and a sensing portion; and sensing means operatively coupled to the sensing portion of the elongated member, the sensing means generating an uplift signal when the uplift contacting portion contacts an uplift on a surface to which said sensor is applied.

2. An uplift sensor as defined by claim 1 wherein the mounting frame is wedge-shaped and is provided with a front angled portion.

3. An uplift sensor as defined by claim 2 wherein the elongated member is pivotally coupled to the mounting frame by a pivot pin, the uplift contacting portion of the elongated member is provided with an uplift contacting tip that extends beyond the mounting frame in a longitudinal direction substantially parallel to the longitudinal axis of the mounting frame.

4. An uplift sensor as defined by claim 3 wherein the bottom of the mounting frame is provided with an elongated narrow skid plate which comes into sliding contact with a surface on which said sensor is applied, the skid plate is provided with a forward tip and a longitudinal surface contact axis that is substantially parallel to the longitudinal axis of the mounting bracket.

5. An uplift sensor as defined by claim 4 wherein the sensing means comprises a hydraulic cylinder and piston assembly wherein the piston is coupled to the sensing portion of the elongated member, the uplift signal generated by the sensing means comprising a hydraulic pressure signal.

6. An uplift sensor as defined by claim 5 further comprising a biasing spring operatively positioned between the mounting frame and the elongated member for biasing the uplift contacting portion of the elongated member into contact with an uplift.

7. An uplift sensor as defined by claim 6 wherein the sensing means has an uplift sensing threshold which is defined by the longitudinal surface contact axis of the skid plate and the axis defined by the forward tip of the skid plate and the uplift contacting tip of the elongated member.

8. A work vehicle for performing a work operating, the vehicle comprising:

a supporting structure;

surface engaging means extending from the supporting structure which engage the ground and support the supporting structure above a planar surface;

at least one operative member for performing a work operation;

a prime mover for supplying power to the operative member;

an uplift sensor mounted to the operative member, the uplift sensor comprising a mounting frame having an elongated longitudinal axis, the mounting frame having a bottom which is adapted and constructed to maintain sliding contact with a surface on which said sensor is applied, an elongated member pivotally secured to the mounting frame substantially parallel to the longitudinal axis of the mounting frame, the elongated member having an uplift contacting portion and a sensing portion, and sensing means operatively coupled to the sensing portion of the elongated member, the sensing means generating an uplift signal when the uplift contacting portion contacts an uplift on a surface to which said sensor is applied.

9. A work vehicle as defined by claim 8 further comprising a control means for controlling the movement and operation of the work vehicle, and a display means for displaying operational data for controlling the vehicle.

10. A work vehicle as defined by claim 9 wherein the control means and the display means is located remote from the vehicle.

11. A work vehicle as defined by claim 9 wherein the mounting frame is wedge-shaped and is provided with a front angled portion.

12. A work vehicle as defined by claim 11 wherein the elongated member is pivotally coupled to the mounting frame by a pivot pin, the uplift contacting portion of the elongated member is provided with an uplift contacting tip that extends beyond the mounting frame in a longitudinal direction substantially parallel to the longitudinal axis of the mounting frame.

13. A work vehicle as defined by claim 12 wherein the bottom of the mounting frame is provided with an elongated narrow skid plate which comes into sliding contact with a surface on which said sensor is applied, the skid plate is provided with a forward tip and a longitudinal surface contact axis that is substantially parallel to the longitudinal axis of the mounting bracket.

14. A work vehicle as defined by claim 13 wherein the sensing means comprises a hydraulic cylinder and piston assembly wherein the piston is coupled to the sensing portion of the elongated member, the uplift signal generated by the sensing means comprising a hydraulic pressure signal.

15. A work vehicle as defined by claim 14 further comprising a biasing spring operatively positioned between the mounting frame and the elongated member for biasing the uplift contacting portion of the elongated member into contact with an uplift.

16. A work vehicle as defined by claim 15 wherein the sensing means has an uplift sensing threshold which is defined by the longitudinal surface contact axis of the skid plate and the axis defined by the forward tip of the skid plate and the uplift contacting tip of the elongated member.

17. A work vehicle as defined by claim 16 wherein the hydraulic cylinder is provided with a hydraulic line that is operatively coupled to the sensing means.

18. A work vehicle as defined by claim 17 wherein the sensing means is an electronic pressure sensor that is electrically coupled to the display means for displaying the uplift signal.

19. A work vehicle as defined by claim 18 wherein the display means and the electronic pressure sensor are protected by armor and are operatively coupled to the sensing means by the hydraulic line.

* * * * *